US010007220B2

(12) United States Patent
Zaima

(10) Patent No.: US 10,007,220 B2
(45) Date of Patent: Jun. 26, 2018

(54) IMAGE FORMING APPARATUS WITH IMAGE CORRECTION USING MEASUREMENT IMAGE AND IMAGE FORMING METHOD

(71) Applicant: CANON KABUSHIKI KAISHA, Tokyo (JP)

(72) Inventor: Nobuhiko Zaima, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/432,315

(22) Filed: Feb. 14, 2017

(65) Prior Publication Data

US 2017/0242382 A1 Aug. 24, 2017

(30) Foreign Application Priority Data

Feb. 22, 2016 (JP) ..... 2016-031380

(51) Int. Cl.
*G03G 15/00* (2006.01)
*G03G 15/01* (2006.01)

(52) U.S. Cl.
CPC ..... *G03G 15/5033* (2013.01); *G03G 15/01* (2013.01)

(58) Field of Classification Search
CPC ..... G03G 15/01; G03G 15/5033
See application file for complete search history.

(56) References Cited

U.S. PATENT DOCUMENTS

| | | | | |
|---|---|---|---|---|
| 5,697,012 | A * | 12/1997 | Sasanuma | G03G 15/01 347/115 |
| 6,148,158 | A * | 11/2000 | Amemiya | G03G 15/01 358/519 |
| 6,418,281 | B1 | 7/2002 | Ohki | 399/49 |
| 6,731,888 | B2 | 5/2004 | Suzuki et al. | 399/49 |
| 8,705,137 | B2 | 4/2014 | Zaima | 358/3.26 |
| 8,879,113 | B2 | 11/2014 | Zaima | G03G 15/0173 |
| 2003/0128381 | A1* | 7/2003 | Zaima | H04N 1/40025 358/1.9 |
| 2004/0131371 | A1* | 7/2004 | Itagaki | G03G 15/5041 399/49 |

(Continued)

*Primary Examiner* — David Bolduc
(74) *Attorney, Agent, or Firm* — Fitzpatrick, Cella, Harper & Scinto

(57) ABSTRACT

An image forming apparatus includes a correction unit configure to correct image data based on a correction condition; an image bearing member; an image forming unit configured to form an image on the image bearing member, based on the corrected image data; a transfer unit configured to transfer the image onto a recording material; a measurement unit configured to measure a measurement image formed on the image bearing member; and a converting unit configured to convert, based on a conversion condition, a measurement result of the measurement image measured by the measurement unit. A printer controller controls the image forming unit to form the measurement image, control the measurement unit to measure the measurement image, control the converting unit to convert the measurement result of the measurement image, and generate the correction condition based on the measurement result converted by the converting unit.

6 Claims, 14 Drawing Sheets

(56) References Cited

U.S. PATENT DOCUMENTS

| | | | | |
|---|---|---|---|---|
| 2005/0190386 | A1* | 9/2005 | Zaima | H04N 1/4078 358/1.9 |
| 2010/0290799 | A1* | 11/2010 | Komiya | G03G 15/5033 399/49 |
| 2010/0315685 | A1* | 12/2010 | Zaima | G03G 15/5062 358/3.26 |
| 2011/0109920 | A1* | 5/2011 | Nakase | G03G 15/5008 358/1.5 |
| 2011/0304887 | A1* | 12/2011 | Nakase | G03G 15/5033 358/3.24 |
| 2012/0033276 | A1* | 2/2012 | Zaima | H04N 1/6033 358/518 |
| 2012/0314227 | A1* | 12/2012 | Zaima | G06K 15/027 358/1.2 |
| 2014/0185071 | A1 | 7/2014 | Zaima | G06K 15/027 |
| 2015/0098095 | A1* | 4/2015 | Zaima | H04N 1/6005 358/1.2 |
| 2016/0041488 | A1* | 2/2016 | Matsuoka | G03G 15/5062 399/15 |
| 2016/0085194 | A1* | 3/2016 | Shirafuji | G03G 15/5025 399/49 |

* cited by examiner

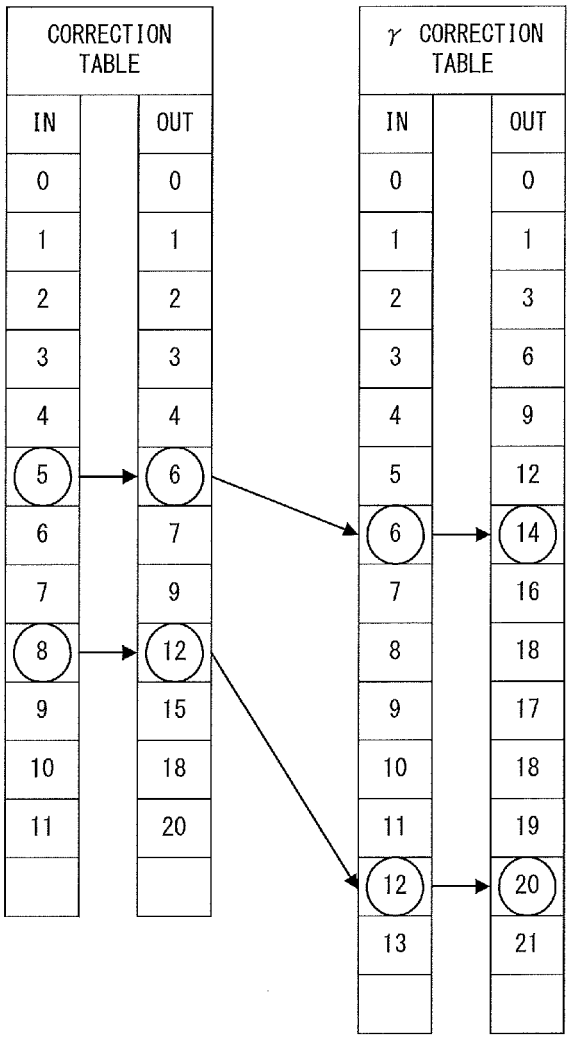

FIG. 17

| ITEMS | | INDIVIDUAL DIFFERENCE OF PHOTOSENSOR | IMAGE DENSITIES ON PHOTOSENSITIVE DRUM AND IMAGE DENSITIES ON RECORDING MATERIAL | IMAGE DENSITIES ON PHOTOSENSITIVE DRUM AND DEVELOPER DENSITY |
|---|---|---|---|---|
| SECOND CONTROL SYSTEM | EFFECTS | YES | YES | NO |
| | COUNTER-MEASURE | GENERATE DENSITY CONVERSION TABLE | GENERATE DENSITY CONVERSION TABLE | — |
| DEVELOPER DENSITY CONTROL | EFFECTS | YES | NO | YES |
| | COUNTER-MEASURE | SET INITIAL DENSITY | — | SET INITIAL DENSITY |

FIG. 18

IMAGE FORMING APPARATUS WITH IMAGE CORRECTION USING MEASUREMENT IMAGE AND IMAGE FORMING METHOD

BACKGROUND OF THE INVENTION

Field of the Invention

The present invention relates to an image forming apparatus, for example, a copying machine or a printer.

Description of the Related Art

An image forming apparatus performs processing for improving image quality after completion of a warm-up process upon startup, for example. For example, the image forming apparatus forms a particular pattern, for example, a gradation pattern, on a recording material, for example, paper, and reads the particular pattern by an image reading apparatus, for example, a scanner. The image forming apparatus feeds back information in accordance with the read particular pattern to image forming conditions, such as a gradation correction value.

The image forming apparatus needs to maintain highly accurate image density characteristics stably for a long time. In this case, the image forming apparatus reads the gradation pattern formed on the recording material, and generates a gradation correction table based on information in accordance with the read gradation pattern. The image forming apparatus stores densities of the gradation pattern formed on a photosensitive member using the generated gradation correction table, and adjusts the gradation correction table at a predetermined timing depending on a relationship between densities of an image formed on the photosensitive member and the stored densities (U.S. Pat. No. 6,418,281).

However, the detected densities of the particular pattern, for example, the gradation pattern formed on an image bearing member, for example, the photosensitive member, and the image densities of the particular pattern formed on the recording material do not match. Therefore, after the gradation correction table is generated based on the particular pattern formed on the recording material, there is a need to form the same particular pattern again on the image bearing member to obtain target densities of the particular pattern, and the processing takes time. This may cause a reduction in efficiency of the image forming processing. To address this problem, it is an object of the present invention to provide an image forming apparatus with increased efficiency of processing for maintaining stability of image density characteristics.

SUMMARY OF THE INVENTION

An image forming apparatus according to the present disclosure includes: a correction unit configure to correct image data based on a correction condition; an image bearing member; an image forming unit configured to form an image on the image bearing member, based on the corrected image data; a transfer unit configured to transfer the image onto a recording material; a measurement unit configured to measure a measurement image formed on the image bearing member; a converting unit configured to convert, based on a conversion condition, a measurement result of the measurement image measured by the measurement unit; a first generating unit configured to: control the image forming unit to form the measurement image, control the measurement unit to measure the measurement image, control the converting unit to convert the measurement result of the measurement image, and generate the correction condition based on the measurement result converted by the converting unit; and a second generating unit configured to: control the image forming unit to forma test image, control the transfer unit to transfer the test image onto the recording material, obtain reading data, and generate the correction condition based on the reading data, wherein the reading data is output from the reading device, wherein the reading data corresponds to a reading result of the test image by reading device, wherein the second generating unit controls the measurement unit to measure the test image formed on the image bearing member before the test image is transferred onto the recording material, and generates the conversion condition based on the reading data and the measurement result of the test image by the measurement unit.

Further features of the present invention will become apparent from the following description of exemplary embodiments (with reference to the attached drawings).

BRIEF DESCRIPTION OF THE DRAWINGS

FIG. 17 is a diagram for illustrating generation of the γ correction table.

FIG. 18 is a table for showing items that affect detection values from the photosensor and image densities on the recording material.

DESCRIPTION OF THE EMBODIMENTS

Figure 1:
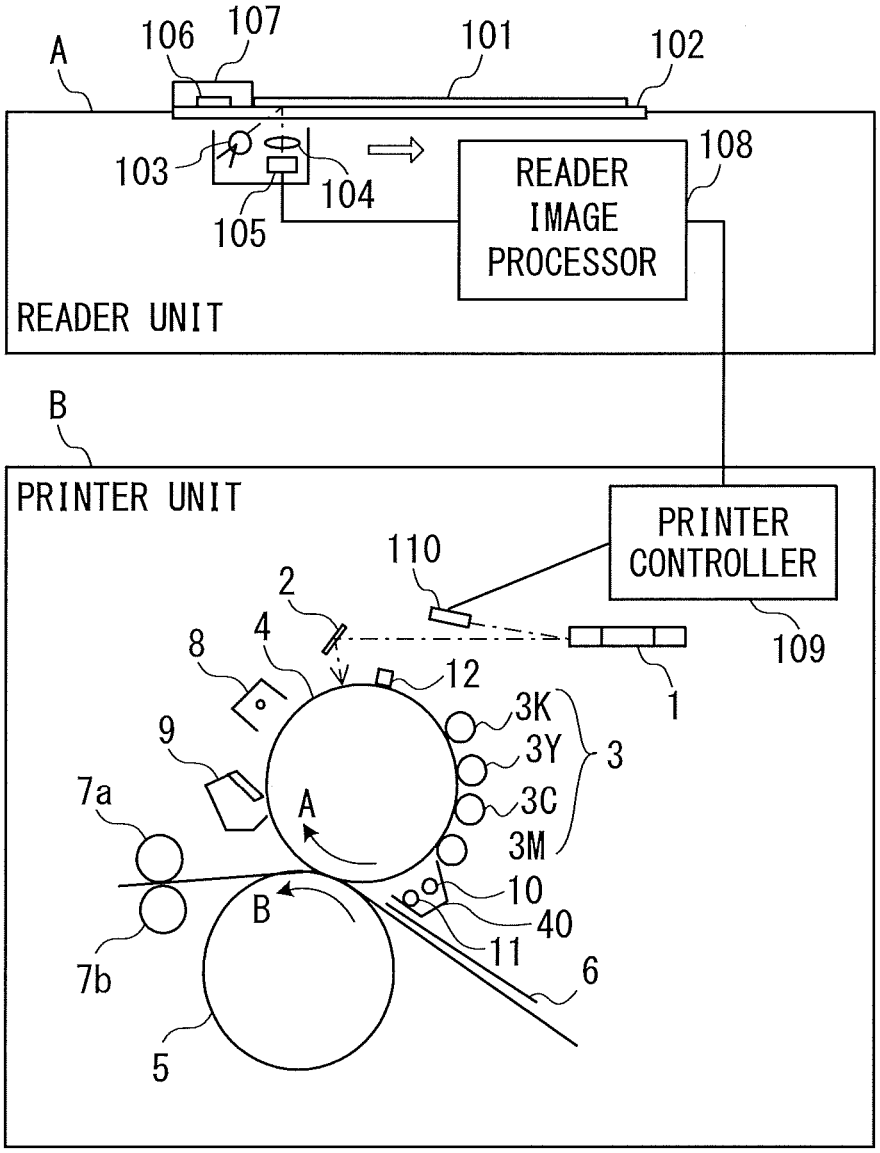
FIG. 1 is a diagram for illustrating a configuration of an image forming apparatus.

FIG. 1 is a diagram for illustrating a configuration of an image forming apparatus according to an embodiment of the present invention. The image forming apparatus includes a reader unit A and a printer unit B. The reader unit A is an image reading apparatus, which is configured to read an original image. The printer unit B is configured to form, for example, an image corresponding to the original image read by the reader unit A on a recording material 6, for example, paper.

Reader Unit

The reader unit A includes a platen 102, on which an original 101 is placed, alight source 103, which is configured to irradiate the original 101 on the platen 102 with light, an optical system 104, a light receiving unit 105, and a reader image processor 108. On the platen 102, a registration member 107 and a reference white plate 106 are arranged. The registration member 107 is used to place the original 101 at a correct position. The reference white plate 106 is used to determine a white level of the light receiving unit 105 and to correct shading.

The light source 103 is configured to irradiate the original 101 placed on the platen 102. The light receiving unit 105 is configured to receive light with which the light source 103 irradiates the original 101 and which is reflected by the original 101, via the optical system 104. The light receiving unit 105 generates color component signals, which are electrical signals indicating red, green, and blue colors, based on the received reflected light, and transmits the generated color component signals to the reader image processor 108. Such light receiving unit 105 is formed, for example, of charge coupled device (CCD) sensors. For example, the light receiving unit 105 includes CCD line sensors arranged in three rows to correspond to the red, green, and blue colors, respectively, and generates red, green, and blue color component signals based on reflected light received by the CCD line sensors. The light source 103, the optical system 104, and the light receiving unit 105 integrally form a reading unit, which is movable in the left and right direction of FIG. 1. The CCD line sensors of the light receiving unit 105 include CCD sensors arrayed in the depth direction of FIG. 1. Therefore, the reading unit is moved with the depth direction of FIG. 1 being one line to sequentially read the entire original 101 line by line, to thereby generate the color component signals for each line.

Figure 2:
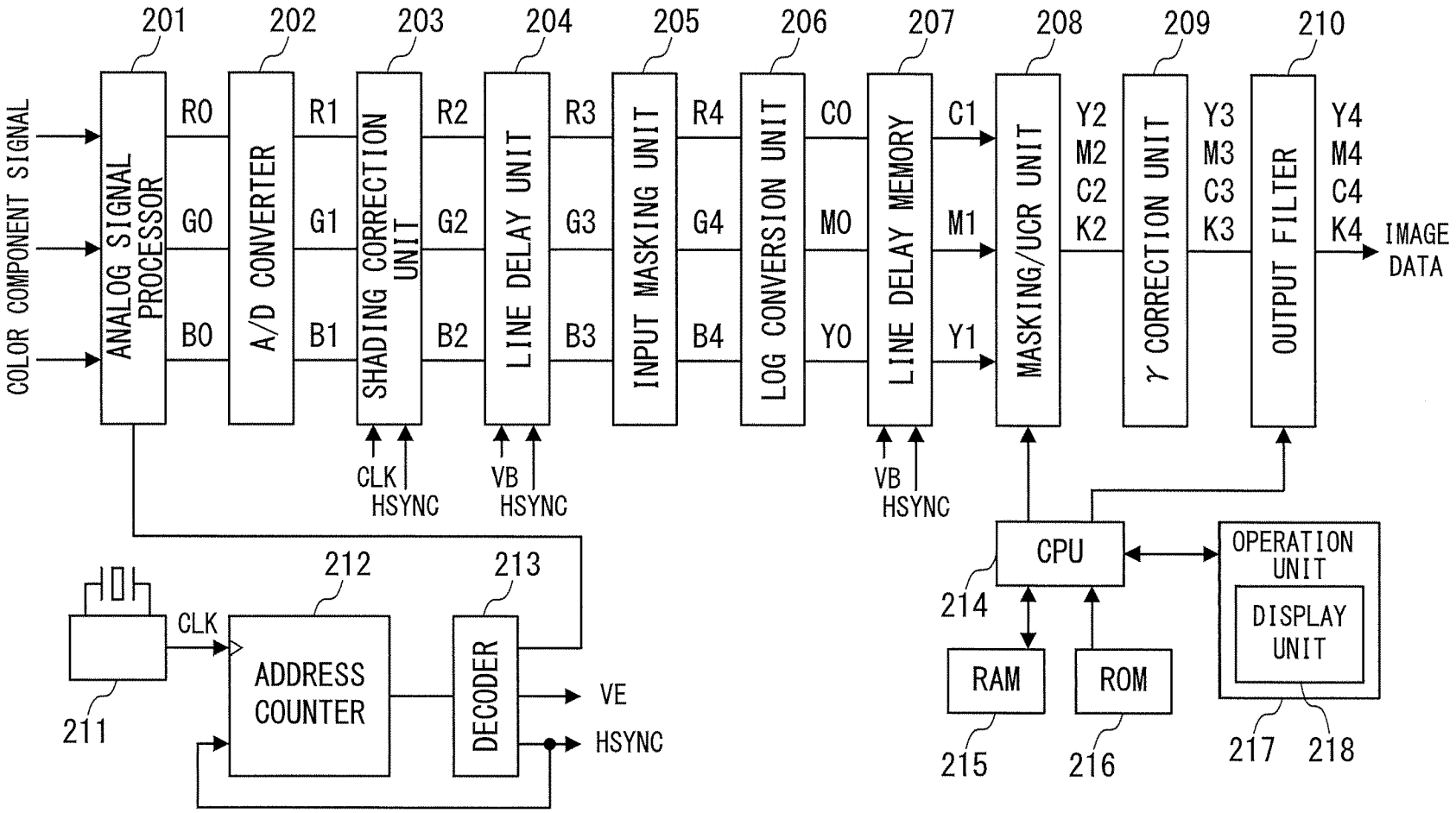
FIG. 2 is an explanatory diagram of a reader image processor.

The reader image processor 108 is configured to perform image processing on the color component signals of the respective colors to generate image data indicating an image of the original 101. The reader image processor 108 transmits the generated image data to the printer unit B. FIG. 2 is an explanatory diagram of the reader image processor 108.

The reader image processor 108 acquires the color component signals of the respective colors from the light receiving unit 105 via an analog signal processor 201. The analog signal processor 201 is configured to perform analog processing, for example, gain adjustment and offset adjustment, on the acquired color component signals of the respective colors. The analog signal processor 201 transmits analog image signals R0, G0, and B0, which are generated through the analog processing, to an analog-to-digital (A/D) converter 202. The reference symbols "R", "G", and "B" indicate red, green, and blue, respectively. Moreover, in this embodiment, an image signal indicates brightness. The A/D converter 202 is configured to convert the analog image signals R0, G0, and B0, which are acquired from the analog signal processor 201, into 8-bit digital image signals R1, G1, and B1, for example. The A/D converter 202 transmits the image signals R1, G1, and B1, which have been generated through the digital conversion, to a shading correction unit 203. The shading correction unit 203 is configured to perform, on the image signals R1, G1, and B1 acquired from the A/D converter 202, known shading correction for each color using a reading result from the reference white plate 106. The shading correction unit 203 generates image signals R2, G2, and B2 through the shading correction.

A clock generation unit 211 is configured to generate a clock signal CLK. The clock signal CLK is input not only to the shading correction unit 203, but also to a line delay unit 204 and a line delay memory 207, which are to be described later. The clock signal CLK is also input to an address counter 212. The address counter 212 is configured to count the clock signals CLK to generate an address (main scanning address) of one line in a main scanning direction. A decoder 213 is configured to decode the main scanning address generated by the address counter 212 to generate a CCD drive signal for each line, for example, shift pulses and reset pulses, a VE signal, and a line synchronization signal HSYNC. The VE signal indicates an effective region of the color component signals, which are acquired from the light receiving unit 105 and correspond to one line. The address counter 212 is cleared by the line synchronization signal HSYNC, and starts counting main scanning addresses for the next line.

The line delay unit 204 receives the line synchronization signal HSYNC as an input, and corrects a spatial deviation in a sub-scanning direction for the image signals R2, G2, and B2 to generate image signals R3, G3, and B3. The CCD line sensors, which are included in the light receiving unit 105 and correspond to the respective colors, are arranged at predetermined intervals in the sub-scanning direction. The line delay unit 204 corrects the spatial deviation caused by the predetermined intervals in the sub-scanning direction. For example, the line delay unit 204 is configured to apply a line delay to the image signals R2 and G2 with respect to the image signal B2 in the sub-scanning direction.

An input masking unit 205 converts a read color space, which is determined by spectral characteristics of red, green, and blue filters of the CCD sensors of the light receiving unit 105, into a standard color space, for example, the National Television Standards Committee (NTSC). As a result, the input masking unit 205 generates image signals R4, G4, and B4 from the image signals R3, G3, and B3. The input masking unit 205 calculates the image signals R4, G4, and B4 by the following matrix operations, for example.

$$R4=a_{11}*R3+a_{12}*G3+a_{13}*B3$$

$$G4=a_{21}*R3+a_{22}*G3+a_{23}*B3$$

$$B4=a_{31}*R3+a_{32}*G3+a_{33}*B3$$

Here, $a_{11}$ to $a_{13}$, $a_{21}$ to $a_{23}$, and $a_{31}$ to $a_{33}$ are constants.

A LOG conversion unit 206 is a light amount/density conversion unit configured to convert brightnesses indicated by the image signals R4, G4, and B4 into image signals C0, M0, and Y0 indicating densities at the time of image formation. The LOG conversion unit 206 includes a color conversion look-up table for converting the image signals R4, G4, and B4 into the image signals C0, M0, and Y0, and is configured to perform the conversion using the color conversion look-up table. The color conversion look-up table is a multi-dimensional table showing the correspondence between the image signals R4, G4, and B4 (input values) and the image signals C0, M0, and Y0 (output values). The LOG conversion unit 206 is not limited to the configuration in which the image signals are converted based on the color conversion table, but may have a configuration in which the image signals are converted based on mathematical expressions, for example. The reference symbols "C", "M", and "Y" indicate cyan, magenta, and yellow, respectively.

The line delay memory 207 delays the image signals C0, M0, and Y0 by a line delay until a black character determination unit (not shown) generates a determination signal, for example, under color removal (UCR), FILTER, or SEN from the image signals R4, G4, and B4. A masking/UCR unit 208 acquires image signals C1, M1, and Y1, which are obtained after the delay, from the line delay memory 207, and extracts an image signal K2 indicating a black density using the image signals C1, M1, and Y1 of three primary colors. The masking/UCR unit 208 also performs processing for correcting impurity of color of the recording material 6 in the printer unit B to generate image signals Y2, M2, and C2. The masking/UCR unit 208 outputs the image signals Y2, M2, C2, and K2 at a predetermined bit width (in this embodiment, 8 bits).

In order to correct gradient characteristics of an image output from the printer unit B to ideal gradient characteristics, a γ correction unit 209 converts the image signals Y2, M2, C2, and K2 into image signals Y3, M3, C3, and K3 using a look-up table (LUT) to be described later. The LUT corresponds to a conversion condition for converting the image signals, and is stored in a printer controller 109. The LUT is provided for each color, and is a one-dimensional table in which the correspondence between the image signal Y2 (8 bits) and the image signal Y3 (8 bits) are defined, for example. The LUT is different from the color conversion look-up table described above. The γ correction unit 209 is not limited to the configuration in which the image signals are converted based on the one-dimensional table, but may have a configuration in which the image signals are converted based on mathematical expressions, for example. An output filter 210 performs edge enhancement or smoothing on the image signals Y3, M3, C3, and K3 through spatial filtering. As a result, the output filter 210 generates frame-sequential image signals Y4, M4, C4, and K4, and transmits the generated frame-sequential image signals Y4, M4, C4, and K4 to the printer unit B as the image data.

The above-mentioned processing using the reader image processor 108 is controlled by a central processing unit (CPU) 214 configured to control processing of the entire reader unit A. The CPU 214 executes a computer program read from a read-only memory (ROM) 216 using a random access memory (RAM) 215 as a working area to control the processing of the entire reader unit A. To the reader unit A, an operation unit 217 including a display unit 218 is connected. The operation unit 217 includes various key buttons, and a touch panel using the display unit 218, and functions as a user interface. A user may operate the operation unit 217 to input various instructions.

Printer Unit

In order to form an image on the recording material 6, for example, paper, the printer unit B includes a photosensitive drum 4, which is an image bearing member, a charger 8, developing units 3, a cleaner 9, a transfer drum 5, a pair of fixing rollers 7*a* and 7*b*, a laser light source 110, a polygon mirror 1, a mirror 2, and the printer controller 109. A surface potential sensor 12 and a photosensor 40 are provided around the photosensitive drum 4.

The photosensitive drum 4 is a drum-shaped photosensitive member, and is rotated in the arrow A direction when forming an image. A surface of the photosensitive drum 4 is uniformly charged by the charger 8. The laser light source 110 scans, under the control of the printer controller 109, the surface of the photosensitive drum 4 with a laser beam with the main scanning direction being a direction (depth direction in FIG. 1) perpendicular to a direction of rotation of the photosensitive drum 4. The printer controller 109 acquires the image data from the reader image processor 108 of the reader unit A, and controls flickering of the laser beam emitted from the laser light source 110 based on the image data. When the image data is transferred from an external device, for example, a personal computer, the printer controller 109 converts the image data based on the LUT, and controls the flickering of the laser beam emitted from the laser light source 110 based on the converted image data. The laser beam emitted from the laser light source 110 is used to scan the uniformly-charged photosensitive drum 4 via the polygon mirror 1 and the mirror 2. As a result, an electrostatic latent image in accordance with the image data is formed on the surface of the photosensitive drum 4.

The developing units 3 are configured to develop the electrostatic latent image, which has been formed on the photosensitive drum 4, to form a toner image. The developing units 3 include a black developing unit 3K, a yellow developing unit 3Y, a cyan developing unit 3C, and a magenta developing unit 3M, which are arranged around the photosensitive drum 4 in the stated order from the upstream in the direction of rotation of the photosensitive drum 4. For example, when a yellow toner image is to be formed, the yellow developing unit 3Y causes a yellow developer to adhere to an electrostatic latent image that corresponds to yellow and is formed on the photosensitive drum 4 to develop the electrostatic latent image at a timing when the electrostatic latent image passes through a development position. The developing units 3M, 3C, and 3K of the other colors perform development in a similar manner.

The recording material 6 is wrapped around the transfer drum 5, and magenta, cyan, yellow, and black toner images are transferred to be superimposed in the stated order on the recording material 6. The transfer drum 5 is rotated while nipping the recording material 6 between the transfer drum 5 and the photosensitive drum 4 to transfer the toner images from the photosensitive drum 4 onto the recording material 6. To this end, the transfer drum 5 is rotated four times in the arrow B direction to forma full-color image on one recording material 6. The recording material 6 having the toner images transferred thereon is separated from the transfer drum 5, and is conveyed to the pair of fixing rollers 7*a* and 7*b*. The pair of fixing rollers 7*a* and 7*b* convey the recording material 6 while nipping the recording material 6 therebetween to fix the toner images onto the recording material 6. For example, the pair of fixing rollers 7*a* and 7*b* heat and pressurize the recording material 6 to fix the toner images onto the recording material 6 through thermal compression bonding. The pair of fixing rollers 7*a* and 7*b* discharge the recording material 6 having the toner images fixed thereon to the outside of the image forming apparatus. Toner remaining on the photosensitive drum 4 after the transferring to the recording material 6 is removed by the cleaner 9.

The surface potential sensor 12 is provided around the photosensitive drum 4 and between a position irradiated with the laser beam by the laser light source 110 and the developing units 3. The surface potential sensor 12 is configured to detect a potential of the surface of the photosensitive drum 4. The photosensor 40 is provided around the photosensitive drum 4 and between the developing units 3 and the transfer drum 5. The photosensor 40 includes the light source 103 and a photodiode 11. The light source 103 irradiates the surface of the photosensitive drum 4 having the toner images formed thereon with far-red light having a dominant wavelength of about 960 nm. The photodiode 11 receives the light with which the light source 103 irradiates the surface of the photosensitive drum 4 and which is reflected by the surface. As a result, the photosensor 40 may measure an amount of reflected light from a measurement toner image (hereinafter referred to as "measurement image") formed on the photosensitive drum 4.

Figure 3:
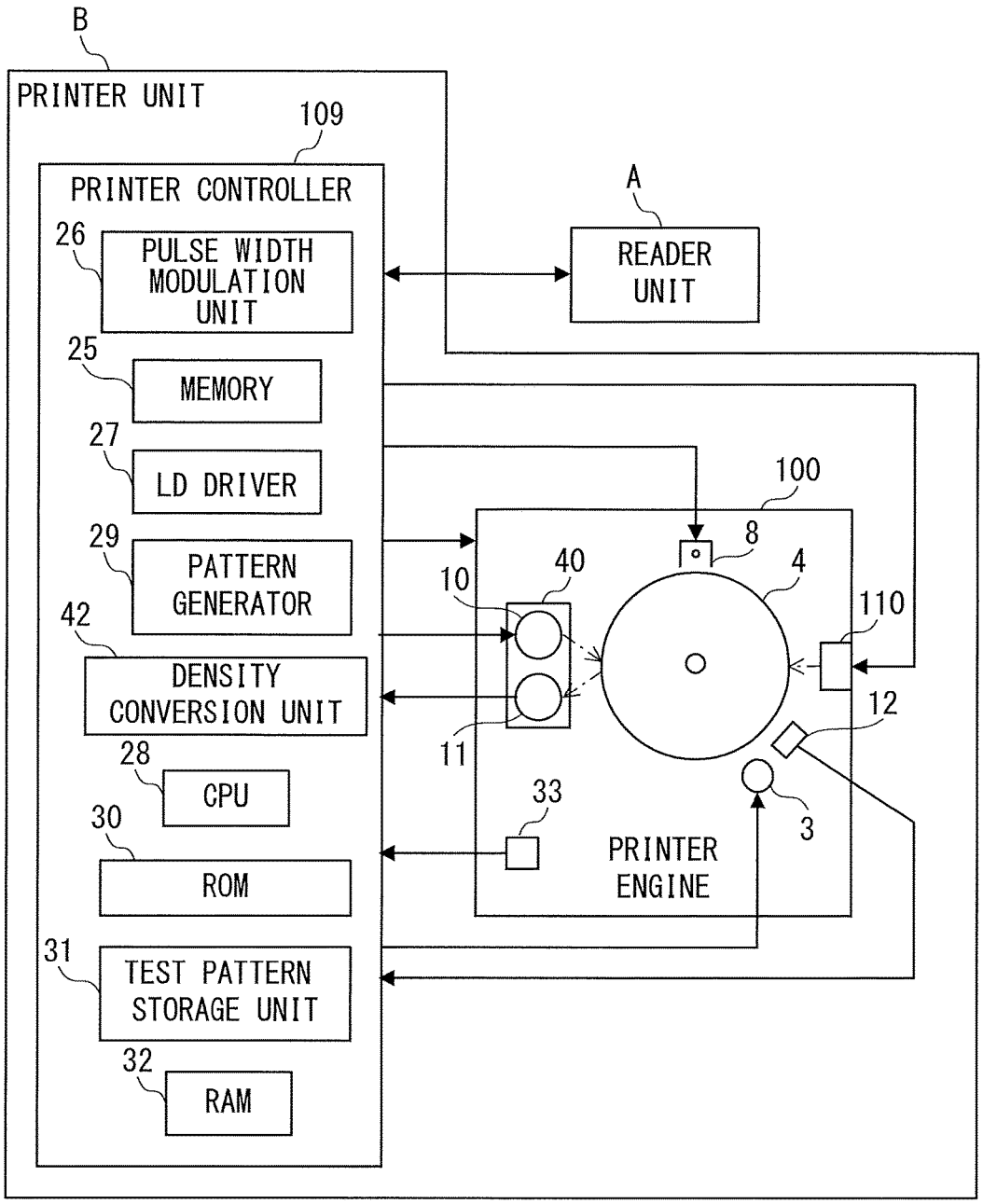
FIG. 3 is an explanatory diagram of a printer controller.

FIG. 3 is an explanatory diagram of the printer controller 109. The printer controller 109 includes a CPU 28, a ROM 30, a RAM 32, a test pattern storage unit 31, a density conversion unit 42, a memory 25 storing an LUT, a pulse width modulation unit 26, an LD driver 27, and a pattern generator 29. The printer controller 109 may communicate with the reader unit A and a printer engine 100. The printer engine 100 includes the photosensitive drum 4, the charger 8, the photosensor 40, the developing units 3, the surface potential sensor 12, the laser light source 110, and an environment sensor 33. The environment sensor 33 is configured to detect environment information, for example, temperature and humidity inside the image forming apparatus. The printer controller 109 is configured to control image forming operation by the printer engine 100 having such configuration. The CPU 28 of the printer controller 109 executes a computer program read from the ROM 30 using the RAM 32 as a working area to control processing of the entire printer unit B. For example, the CPU 28 of the printer controller 109 controls a charging bias of the charger 8 and a developing bias of the developing units 3.

Gradient Control

Figure 4:
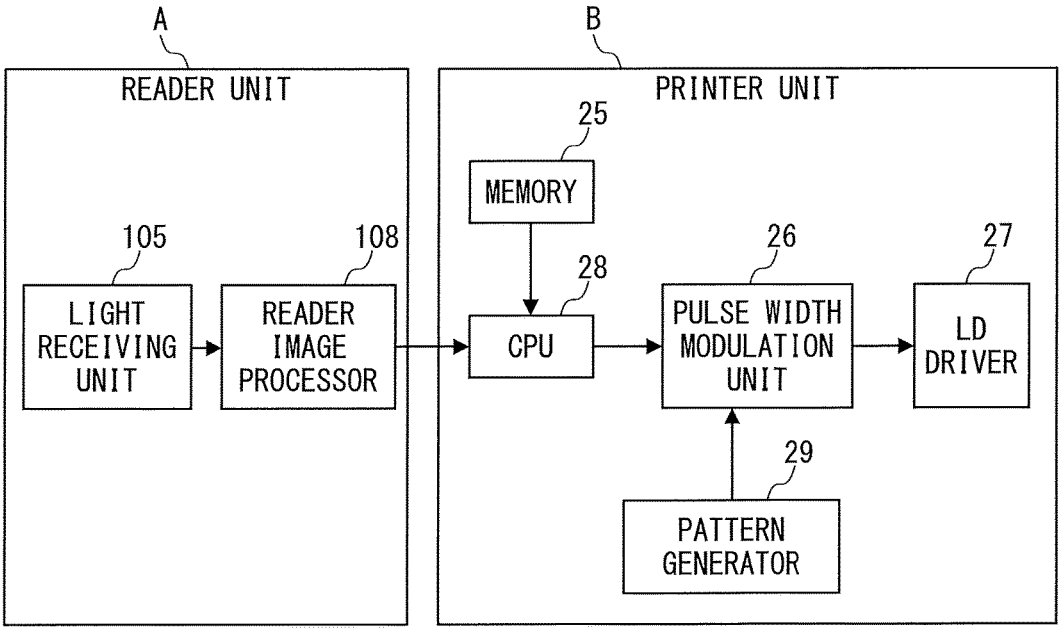
FIG. 4 is a diagram for illustrating processing on a gradation image.

FIG. 4 is a diagram for illustrating processing on a gradation image. As described above, the reader image processor 108 of the reader unit A generates the frame-sequential image signals (image data) based on the color component signals acquired from the light receiving unit 105, and transmits the generated image data to the printer unit B. The printer controller 109 converts the image data, which has been transferred from the reader unit A or the external device, for example, the personal computer, into the image signals Y4, M4, C4, and K4 based on the LUT stored in the memory 25.

Figure 5:
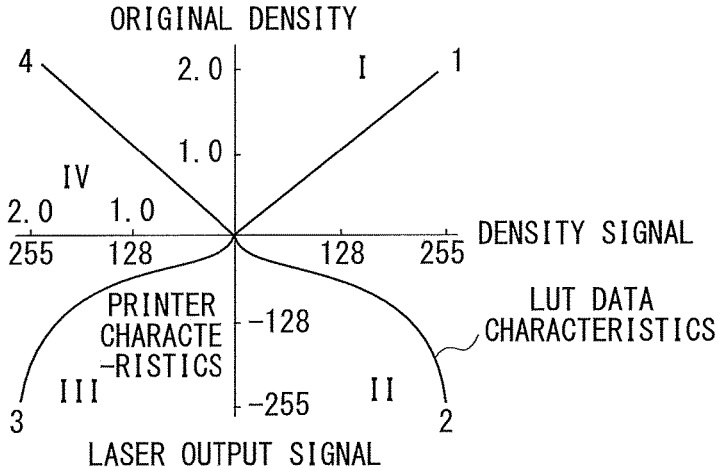
FIG. 5 is a four-quadrant chart for showing how image signals are converted.

FIG. 5 is a four-quadrant chart for showing how the image signals are converted for correcting the gradient characteristics. Quadrant I shows reading characteristics of the reader unit A for converting original densities indicating densities of the image formed on the original 101 into density signals. Quadrant II shows conversion characteristics of the LUT for converting the density signals into laser output signals indicating amounts of light of laser beams output from the laser light source 110. Quadrant III shows recording characteristics of the printer unit B for converting the laser output signals into output densities indicating densities of the image to be formed on the recording material 6. Quadrant IV shows gradient reproduction characteristics of the entire image forming apparatus, which indicate a relationship between image densities of the original 101 to the densities of the image formed on the recording material 6. In this embodiment, the image signals are processed as 8-bit digital signals, and hence the number of gradients is 256 gradients.

In the image forming apparatus according to this embodiment, in order to make the gradient characteristics in quadrant IV linear, non-linear recording characteristics of the printer unit B in quadrant III are corrected with the conversion characteristics of the LUT in quadrant II. The LUT is generated based on an operation result, which is to be described later. The image signals that have been subjected to the density conversion by the CPU 28 based on the LUT are input to the pulse width modulation unit 26. The pulse width modulation unit 26 converts the image signals into pulse signals corresponding to a dot width of the image to be formed, and transmits the pulse signals to the LD driver 27, which is configured to drive the laser light source 110. The pulse width modulation unit 26 converts the image signals into pulse width modulation (PWM) signals, for example, and transmits the PWM signals to the LD driver 27. The LD driver 27 controls light emission of the laser light source 110 based on the pulse signals acquired from the pulse width modulation unit 26.

In this embodiment, the image forming apparatus performs gradient reproduction through pulse width modulation processing for all colors: yellow, magenta, cyan, and black. As described above, the laser beam emitted from the laser light source 110 forms the electrostatic latent image on the photosensitive drum 4. The laser light source 110 is subjected to light emission control based on the pulse signals, and hence the electrostatic latent image having predetermined gradient characteristics corresponding to changes in dot area is formed on the photosensitive drum 4. The electrostatic latent image is reproduced as the gradation image through developing, transferring, and fixing steps.

Figure 6:
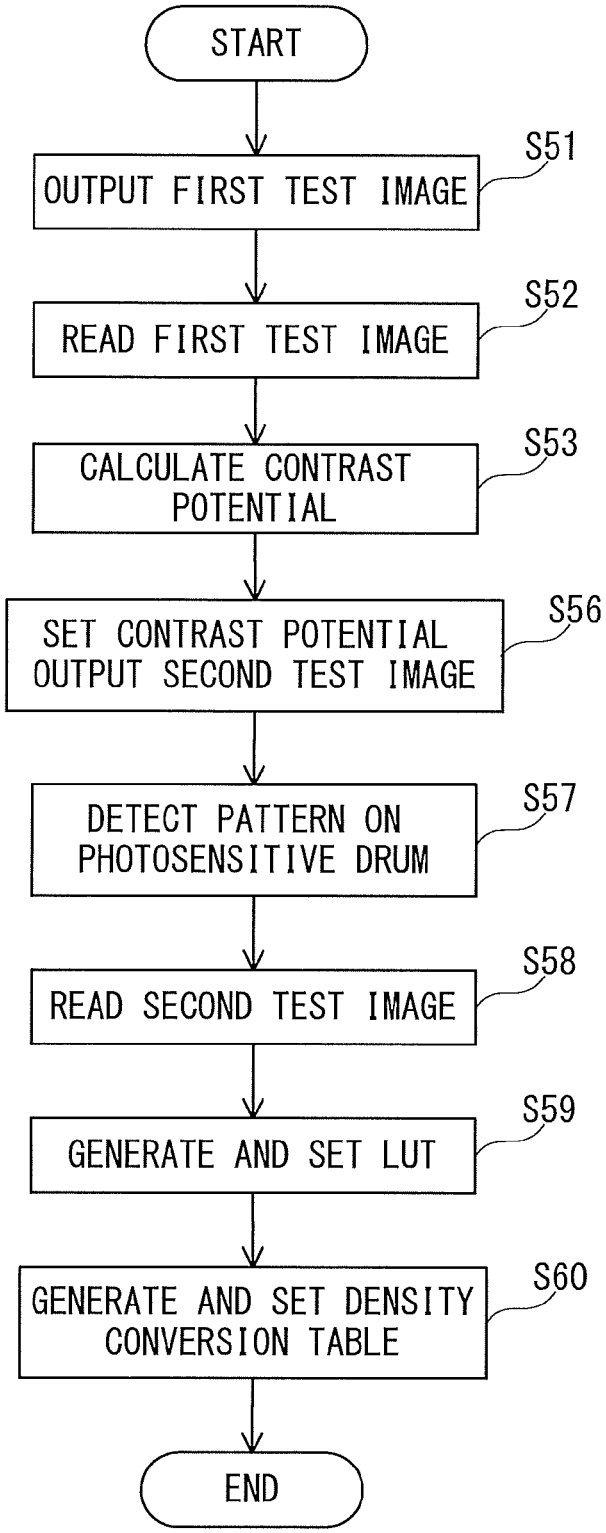
FIG. 6 is a flow chart for illustrating processing for calibrating a printer unit.

A first control system regarding stabilization of image reproduction characteristics by the reader unit A and the printer unit B is described. FIG. 6 is a flow chart for illustrating processing for calibrating the printer unit B using the reader unit A.

Processing of Step S51: When an instruction to automatically correct gradations is input through the operation unit 217, the CPU 214 of the reader unit A starts the processing for calibrating the printer unit B. The CPU 214 first displays, on the display unit 218, a start button for outputting a first test image. When the user presses the start button, the CPU 214 acquires an instruction to output the first test image, which is a measurement image. When acquiring the instruction to output the first test image, the CPU 214 instructs the CPU 28 of the printer unit B to form the first test image. In response to the instruction to form the first test image, the CPU 28 forms the first test image on the recording material 6. The first test image is generated by the pattern generator. At this time, the CPU 28 determines the presence or absence of the recording material 6 for forming the first test image. When notified of the absence of the recording material 6 from the CPU 28, the CPU 214 displays, on the display unit 218, an alert image indicating the absence of the recording material 6. When the first test image is formed, a contrast potential, which is to be described later, is set to a value corresponding to the environment information detected by the environment sensor 33.

Figure 7:
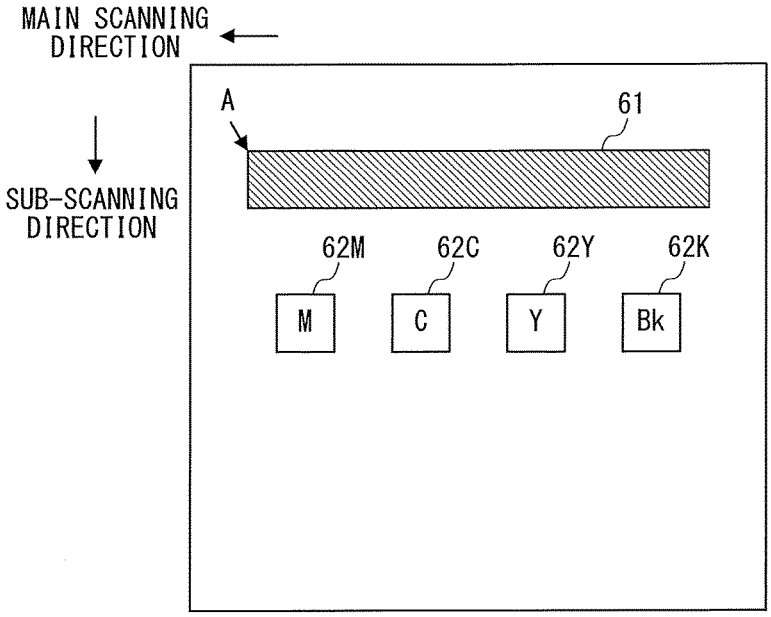
FIG. 7 is a diagram for illustrating a first test image.

FIG. 7 is a diagram for illustrating the first test image. The first test image includes a band pattern 61 at intermediate gradient densities of four colors: yellow (Y), magenta (M), cyan (C), and black (K), and patch patterns 62Y, 62M, 62C, and 62K of respective colors at the maximum density (for example, density signal value=255). The patch patterns 62Y, 62M, 62C, and 62K are formed to have a size that is equal to or less than one line read by the light receiving unit 105 of the reader unit A.

The user may visually inspect the band pattern 61 to check the presence or absence of a streak-like abnormal image, density unevenness, and color unevenness. When the streak-like abnormal image, the density unevenness, and the color unevenness are present, the user gives an instruction to output the first test image again. When the streak-like abnormal image, the density unevenness, and the color unevenness are present again, the image forming apparatus needs repair. The reader unit A may read the band pattern 61 to determine whether or not to perform the subsequent processing based on the densities in the main scanning direction.

Processing of Step S52: The user places the recording material 6 having the first test image formed thereon on the platen 102 of the reader unit A to have the first test image read by the reader unit A. When the recording material 6 is placed on the platen 102, the CPU 214 of the reader unit A displays, on the display unit 218, a start button for reading the image. When the user presses the start button, the CPU 214 performs processing for reading the first test image from the recording material 6 placed on the platen 102. Specifically, the CPU 214 controls operation of the reading unit to read the first test image. The light receiving unit 105 of the reading unit transmits color component signals (read signal values) of the first test image to the reader image processor 108. The reader image processor 108 converts the color component signals (read signal values) acquired from the light receiving unit 105 into the density signals indicating optical densities based on the following expressions. The read signal values include a read signal value for red (R), a read signal value for green (G), and a read signal value for blue (B).

$$M=-km*\log_{10}(G/255)$$

$$C=-kc*\log_{10}(R/255)$$

$$Y=-ky*\log_{10}(B/255)$$

$$K=-kbk*\log_{10}(G/255)$$

Here, km, kc, ky, and kbk are each correction coefficients set in advance.

Without using the above-mentioned expressions, the reader image processor 108 may convert the color component signals into density signals M, C, Y, and K using a predetermined conversion table.

Processing of Step S53: The CPU 214 calculates, based on the density signals M, C, Y, and K (image signals M4, C4, Y4, and K4 in FIG. 2) obtained by the reader image processor 108, the contrast potential for compensating for the maximum density Dmax. The contrast potential is a potential difference between a potential (light potential) in an area in which the electrostatic latent image is formed on the photosensitive drum 4 and a potential (dark potential) in an area in which the electrostatic latent image is not formed on the photosensitive drum 4. The light potential is a surface potential in a region on the photosensitive drum 4 that is irradiated with the laser beam by the laser light source 110. The light potential is determined based on an intensity (exposure amount) of the laser beam emitted from the laser light source 110. Toner adheres to the region having the light potential. The dark potential is a surface potential in a region on the photosensitive drum 4 that is not irradiated with the laser beam by the laser light source 110. The dark potential is determined through the control of the charging bias and the developing bias. The charging bias and the developing bias are determined based on the environment information detected by the environment sensor 33. Toner does not adhere to the region having the dark potential.

The CPU 214 acquires, based on density signals of the band pattern 61 and the patch patterns 62Y, 62M, 62C, and 62K of the first test image, and of a density signal of the unit in which those patterns are not formed, data indicating a relationship between the exposure amount and an adhesion amount of the toner. It has been known that the relationship between the exposure amount and the adhesion amount is linear. Therefore, the CPU 214 may determine the exposure amount with which a target adhesion amount is achieved based on a result of reading the first test image.

Figure 8:
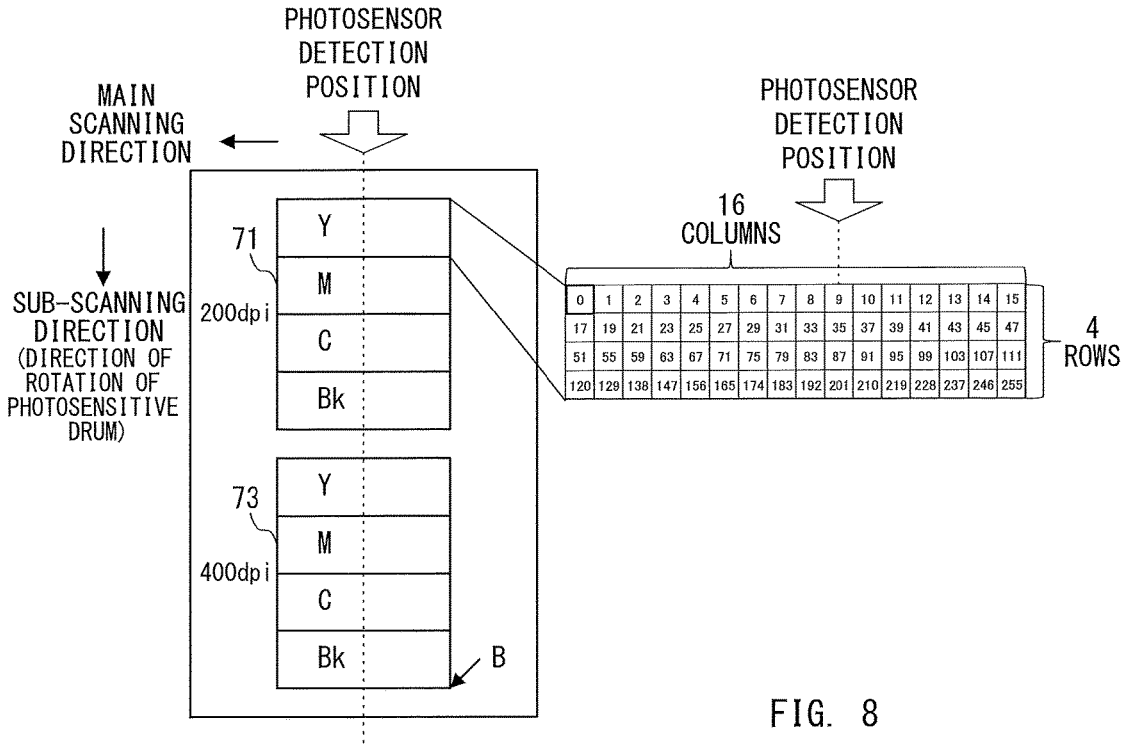
FIG. 8 is a diagram for illustrating a second test image.

Processing of Step S56: The CPU 214 controls the printer unit B based on the contrast potential calculated in the processing of Step S53, and instructs the printer unit B to form a second test image. In response to the instruction, the printer unit B forms the second test image, which is a measurement image. FIG. 8 is a diagram for illustrating the second test image. The second test image includes a 64-gradient (16 columns, 4 rows) patch image for each color of yellow (Y), magenta (M), cyan (C), and black (K). A patch image 71 has a resolution of 200 lines/inch (lpi), and a patch image 72 has a resolution of 400 lpi. Each of the patch images 71 and 72 is formed by the pulse width modulation unit 26 preparing a plurality of triangular wave periods to be used for comparison with the image signals to be processed. The second test image is formed based on measurement image data, which is generated by the pattern generator, without using the LUT. A unit (position indicated by the arrow) of the second test image formed on the photosensitive drum 4 is conveyed to a measurement position of the photosensor 40 through rotation of the photosensitive drum 4.

Processing of Step S57: While the second test image is formed on the recording material 6, the CPU 214 causes the photosensor 40 to measure a gradation pattern of the second test image on the photosensitive drum 4. In this example, measured detection values for yellow, magenta, cyan, and black of a gradation pattern are (8, 33, 83, 192), for example.

Processing of Step S58: The user places the recording material 6 having the second test image formed thereon on the platen 102 of the reader unit A to have the second test image read by the reader unit A. When the recording material 6 is placed on the platen 102, the CPU 214 of the reader unit A displays, on the display unit 218, a start button for reading an image. When the user presses the start button, the CPU 214 performs control to read the second test image from the recording material 6 placed on the platen 102. Specifically, the CPU 214 controls operation of the reading unit to read the second test image. The light receiving unit 105 of the reading unit transmits color component signals of the read second test image to the reader image processor 108. The reader image processor 108 converts the color component signals (RGB signal values) acquired from the light receiving unit 105 into density signals indicating optical densities as in the processing of Step S52.

Processing of Step S59: The CPU 214 generates the LUT while substituting coordinates, that is, substituting density levels (density signals) of the 64-gradient patch images of the second test image by input levels (density signal axis in FIG. 5), and the exposure amounts of the laser beam by output levels (laser output signal axis in FIG. 5). The density signals are acquired from a result of reading the second test image by the reader unit A (processing of Step S58). The exposure amount of the laser beam is a light amount corresponding to the contrast potential set at the time when the second test image is formed. The CPU 214 calculates values of density levels not corresponding to the patch images through interpolation processing. The CPU 214 updates the LUT stored in the memory 25 with the generated LUT described above.

Processing of Step S60: The CPU 214 generates and sets a density conversion table for converting the detection values of image densities on the photosensitive drum 4, which have been measured by the photosensor 40 in Step S57, into the densities of the image to be formed on the recording material 6. Details of this processing are described later.

As described above, the first control system using the reader unit A completes 1) the processing for controlling the contrast potential and 2) the generation of the LUT, both of which are image forming conditions. In the processing using the first control system, in order to associate the input image signals and the densities of the image to be finally formed on the recording material 6 with each other, the exposure amount of the laser beam is controlled to set the contrast potential within a predetermined range. Therefore, highly accurate control is performed, and an image having high gradation accuracy may be obtained. However, the user needs to place a test image on the platen 102 of the reader unit A, and it takes time and effort. Therefore, the image forming apparatus performs processing using a second control system, which is to be described later.

Density Conversion Table

Figure 9:
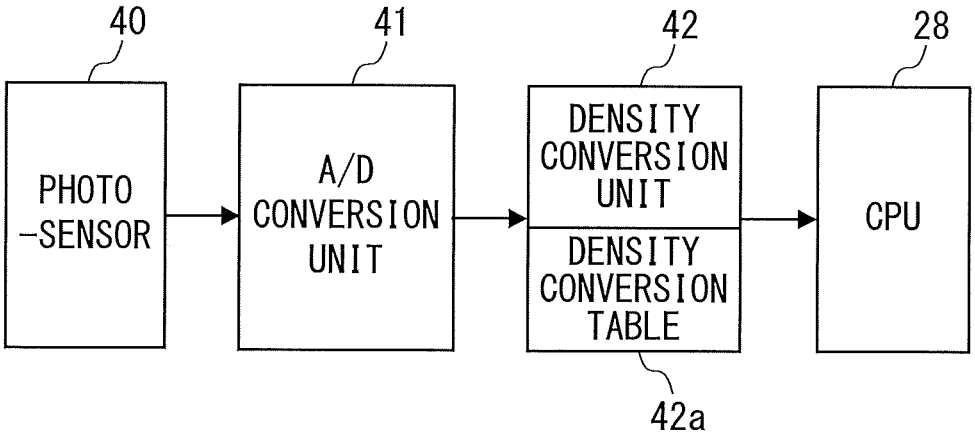
FIG. 9 is a diagram for illustrating processing on a signal output from a photosensor.

The density conversion table is described. FIG. 9 is a diagram for illustrating processing on a signal output from the photosensor 40. The density conversion table is stored in the memory 25. Then, when the CPU 214 updates the density conversion table, the updated density conversion table is stored in the memory 25.

The photosensor 40 receives, through the photodiode 11, the far-red light with which the light source 103 irradiates the photosensitive drum 4 and which is reflected by the photosensitive drum 4. The photosensor 40 converts the far-red light received by the photodiode 11 into an electrical signal (detection value). The electrical signal is an analog signal expressed by a voltage of from 0 V to 5 V, for example. The electrical signal (detection value) is input to an A/D conversion unit 41. The A/D conversion unit 41 converts the input electrical signal into a digital signal at levels of from 0 to 255, for example. The A/D conversion unit 41 inputs the digital signal to the density conversion unit 42. The density conversion unit 42 converts the digital signal into a density value based on a density conversion table 42*a*.

Figure 10:
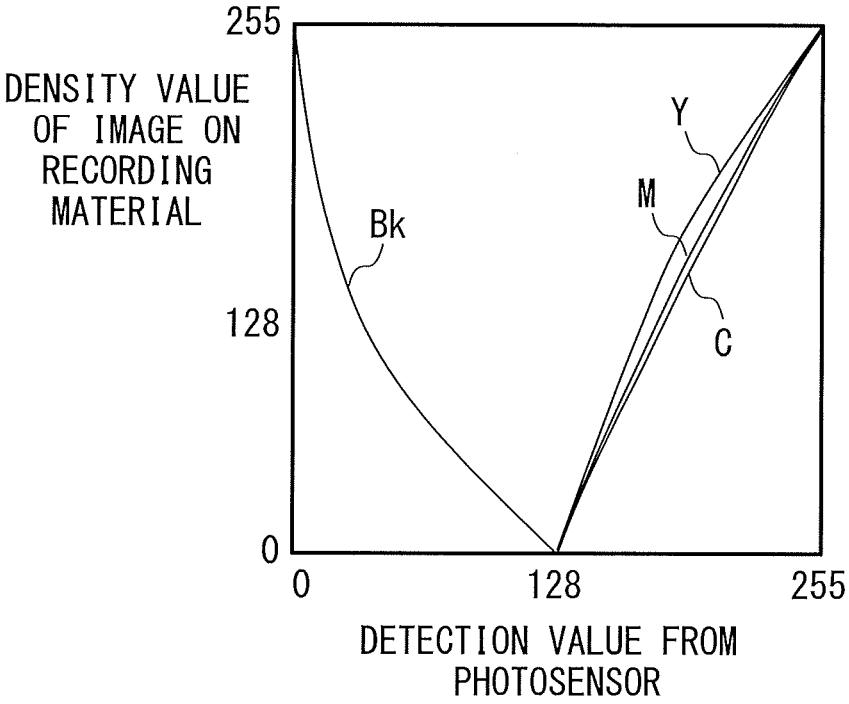
FIG. 10 is a graph for showing a relationship between detection values from the photosensor and densities of an image formed on a recording material.

FIG. 10 is a graph for showing, when densities of an image on the photosensitive drum 4 are gradually changed in area gradation for each color, a relationship between the detection values from the photosensor 40 and the densities of the image formed on the recording material 6. In this example, a detection value output from the photosensor 40 when toner does not adhere to the photosensitive drum 4 is 2.5 V (level 128 in the digital signal).

As an area coverage rate of toner of each color of yellow, magenta, and cyan becomes higher, and the image densities become higher, the detection values output from the photosensor 40 become larger. As an area coverage rate of black toner becomes higher, and the image densities become higher, the detection values output from the photosensor 40 become smaller. Such characteristics are used to generate, for each color, the density conversion table 42*a* for converting the detection values, which are output from the photosensor 40, into the density values of the image to be formed on the recording material 6. Therefore, with the density conversion unit 42 converting the detection values from the photosensor 40 based on the density conversion table 42*a*, the image densities for each color are determined accurately.

There is an individual difference in changes of transferring and fixing characteristics of the image forming apparatus, and characteristics of the photosensor 40. This individual difference affects a relationship between the detection values from the photosensor 40 and the densities of the image formed on the recording material 6. Therefore, with the density conversion table 42*a*, which has been prepared in advance as a fixed table based on standard characteristics of the image forming apparatus and the photosensor 40, the densities of the image on the photosensitive drum 4 have failed to be converted into the densities of the image on the recording material 6 with high accuracy. In particular, when there occur a change with time of the photosensor 40, changes in resistance values of the transfer drum 5 and the recording material 6, and a change in composition of the toner on the recording material 6 heated by the pair of fixing rollers 7*a* and 7*b*, it is difficult to predict the image densities on the recording material 6 from the image densities on the photosensitive drum 4. In order to convert the densities with high accuracy, the density conversion table 42*a* needs to be updated periodically depending on statuses of the image forming apparatus and the photosensor 40.

In this embodiment, the density conversion table 42*a* generated by the first control system may be used for accurate conversion between the densities of the toner image on the photosensitive drum 4 and the densities of the image formed on the recording material 6. In the first control system, the density conversion table 42*a* is generated based on a measurement result of the gradation pattern of the second test image formed on the photosensitive drum 4 from the photosensor 40, and a result of reading the gradation pattern formed on the recording material 6. In other words, the processing using the first control system is performed to periodically calibrate the photosensor 40.

Figure 11:
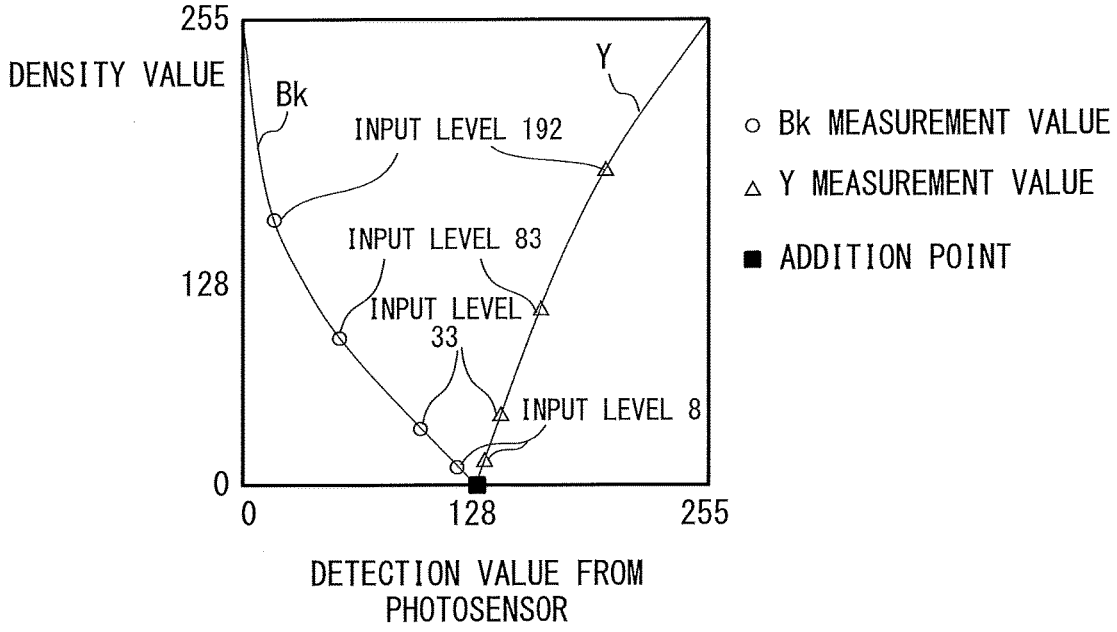
FIG. 11 is a graph for showing a method of generating a density conversion table.

FIG. 11 is a graph for showing a specific method of generating the density conversion table 42*a* in Step S60 of FIG. 6. Density conversion tables for yellow, magenta, and cyan are generated with a similar method. In FIG. 11, a method of generating the density conversion tables for yellow and black is described, and a description is omitted for the other colors.

The CPU 214 determines the correspondence between the detection values from the photosensor 40, which correspond to the second test image acquired in the processing of Step S57 of FIG. 6, and density values of the second test image read by the reader unit A in the processing of Step S58. The CPU 214 sets, as a detection value corresponding to a density value "255" from the photosensor 40, "0" for black, and "255" for yellow. Moreover, the CPU 214 sets, as a detection value corresponding to a density value "0" from the photosensor 40, "128" for both of black and yellow. In this example, density values 0 to 255 are values obtained by normalizing optical densities 0.0 to 2.0 on the recording material 6. The CPU 214 linearly interpolates the total of six values, that is, four density values detected for the respective colors and the density values "0" and "255", and smoothes the obtained result through a moving average to generate the density conversion table 42*a* including conversion values for inputs and outputs 0 to 255. The CPU 214 sets the generated density conversion table 42*a* in the density conversion unit 42.

Long-Term Stabilization of Image Reproduction Characteristics

The second control system performs processing for stabilizing the image reproduction characteristics obtained by the first control system for a long time. The second control system estimates a change in characteristics of the image forming apparatus from a change in image densities of a plurality of images formed in response to the same image signal, and generates the LUT so that the densities of the image formed on the recording material 6 may match with the target densities. In other words, the second control system corrects the LUT generated in the processing using the first control system, based on a difference between a density value detected in the processing using the second control system, which is performed at a predetermined timing, and a reference density value. The reference density value is the density value of the image formed on the photosensitive drum 4 immediately after the processing using the first control system. For example, in a period from when the first control system is executed to when the printer unit B forms an image, the CPU 28 acquires the reference density value from a detection result of the measurement image on the photosensitive drum 4 measured by the photosensor 40, and stores the reference density value in the RAM 32.

Figure 12:
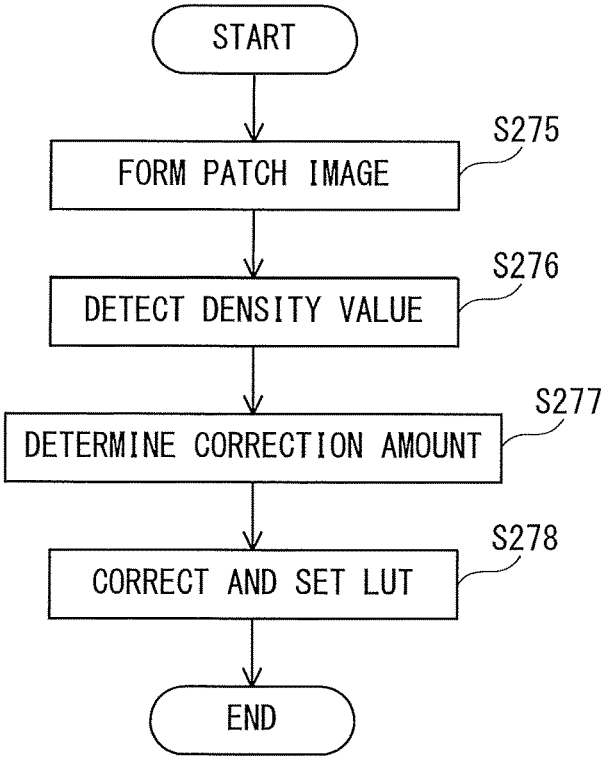
FIG. 12 is a flow chart for illustrating processing for stabilizing image reproduction characteristics for a long time.

FIG. 12 is a flow chart for illustrating processing for stabilizing the image reproduction characteristics by the second control system for a long time. When main power of the image forming apparatus is turned on, after predetermined time has elapsed from when the main power is turned on, or when an environmental change in temperature or humidity is detected by the environment sensor 33, the image forming apparatus performs control using the second control system.

Figure 13:
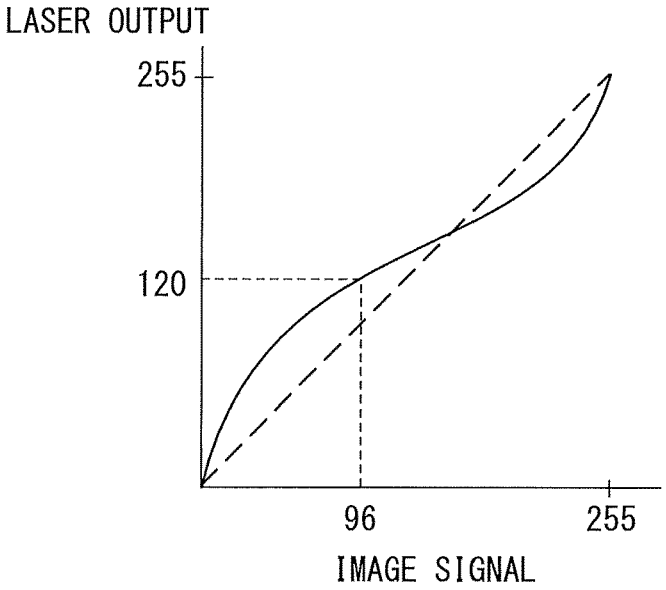
FIG. 13 is a graph for showing processing for determining a laser output signal using an LUT.

When the main power of the image forming apparatus is turned on, the CPU 28 of the printer controller 109 forms patch images of the respective colors of yellow, magenta, cyan, and black on the photosensitive drum 4 (Step S275). An exposure amount (laser output signal) of the laser beam at the time of generating the patch images is controlled based on a predetermined density signal (image signal). The laser output signal is a value obtained by converting a density signal (image signal) of level "96" based on the LUT, for example. FIG. 13 is a graph for showing processing for determining the laser output signal using the LUT. When the patch images are formed using the LUT, level "120" corresponding to the density signal (image signal) of level "96" is the laser output signal. The LUT is provided for each color. Therefore, the laser output signal is set for each color. The laser output signal is set until the LUT is updated in the processing using the first control system, and is not a value in accordance with the LUT corrected by correction control, which is to be described later.

Figure 14:
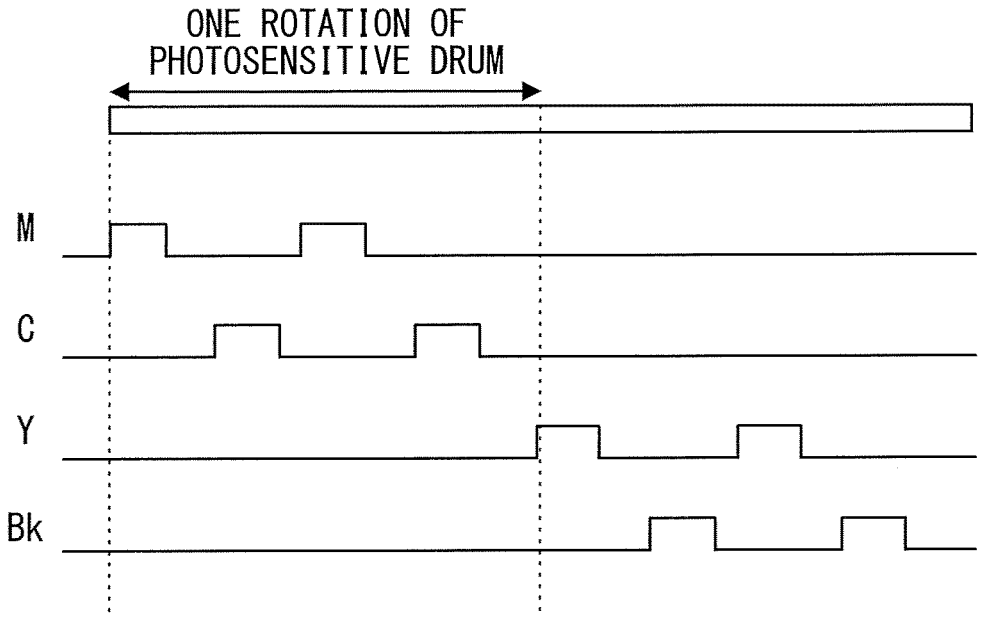
FIG. 14 is a timing chart at the time of forming patch images.

The CPU 28 uses the photosensor 40 to detect density values (patch density values) of the patch images on the photosensitive drum 4 (Step S276). FIG. 14 is a timing chart at the time of forming the patch images. Patch images of two colors are formed at two positions per rotation of the photosensitive drum 4. Patch images of the same color are formed at positions 180° opposed to each other on the photosensitive drum 4. In this embodiment, a photosensitive drum 4 having a large aperture is used. In order to quickly detect patch densities accurately and efficiently even in a case where eccentricity exists in the photosensitive drum 4, the patch images of the same color are formed at the positions 180° opposed to each other on the photosensitive drum 4. The CPU 28 detects the densities of the patch images of the same color at the two positions a plurality of times to calculate an average value of detection results. The CPU 28 acquires detection values of patch images of four colors from the photosensor 40 in two rotations of the photosensitive drum 4. The CPU 28 acquires patch density values, which are obtained by correcting the density values detected by the photosensor 40 with the conversion values in the density conversion table 42*a* shown in FIG. 11.

The CPU 28 compares an acquired patch density value to the reference density value to calculate a difference therebetween, and determines a correction amount of the LUT (Step S277). The density conversion table 42*a* is generated to correspond to the statuses of the image forming apparatus, and hence the detected patch density value may be regarded as corresponding to a density of the image formed on the recording material 6. The reference density value is a density of the image on the recording material 6 when the image is formed with the density signal (image signal) being level "96" in linear gradient characteristics corrected by the first control system. In other words, the normalized density level is "96".

The CPU 28 corrects and sets the LUT based on the correction amount (Step S278). The setting of the LUT completes the processing using the second control system. The second control system uses the CPU 28 to perform the above-mentioned processing at the predetermined timing, and to calculate a correction amount corresponding to an amount of change of the detected patch density value from the reference density value. Then, the CPU 28 combines the calculated correction amount and the LUT, which has been generated by the first control system, to generate one gradation correction table (γ correction table). In other words, after executing the processing using the first control system, a change in density value is detected, and the LUT is corrected so that the detected density value may match with a reference value. The processing using the second control system, in which the correction with reference to the LUT is performed, may be executed at the predetermined timing as described above to compensate for a change in image density characteristics caused by long-term use accurately.

Figure 15:
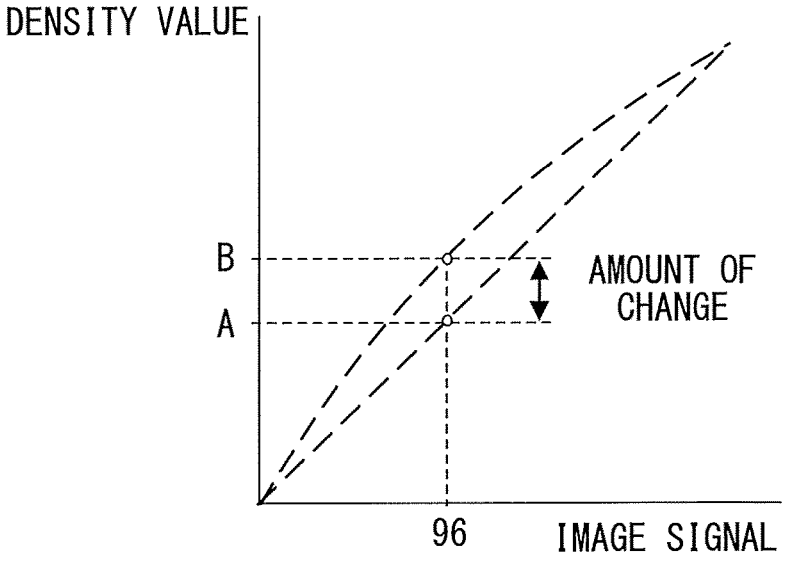
FIG. 15 is a graph for showing an amount of change in density value between images formed with the same image signal.

FIG. 15 is a graph for showing an amount of change in density value between images formed with the same image signals. From the image formed on the photosensitive drum 4 with the image signal having level "96", a density value is detected by the photosensor 40. When the reference density value is "A", and a density value at the time when the main power is turned on is "B", a difference (B-A) between the density values indicated by the vertical axis is the amount of change from the reference density value.

Figure 16:
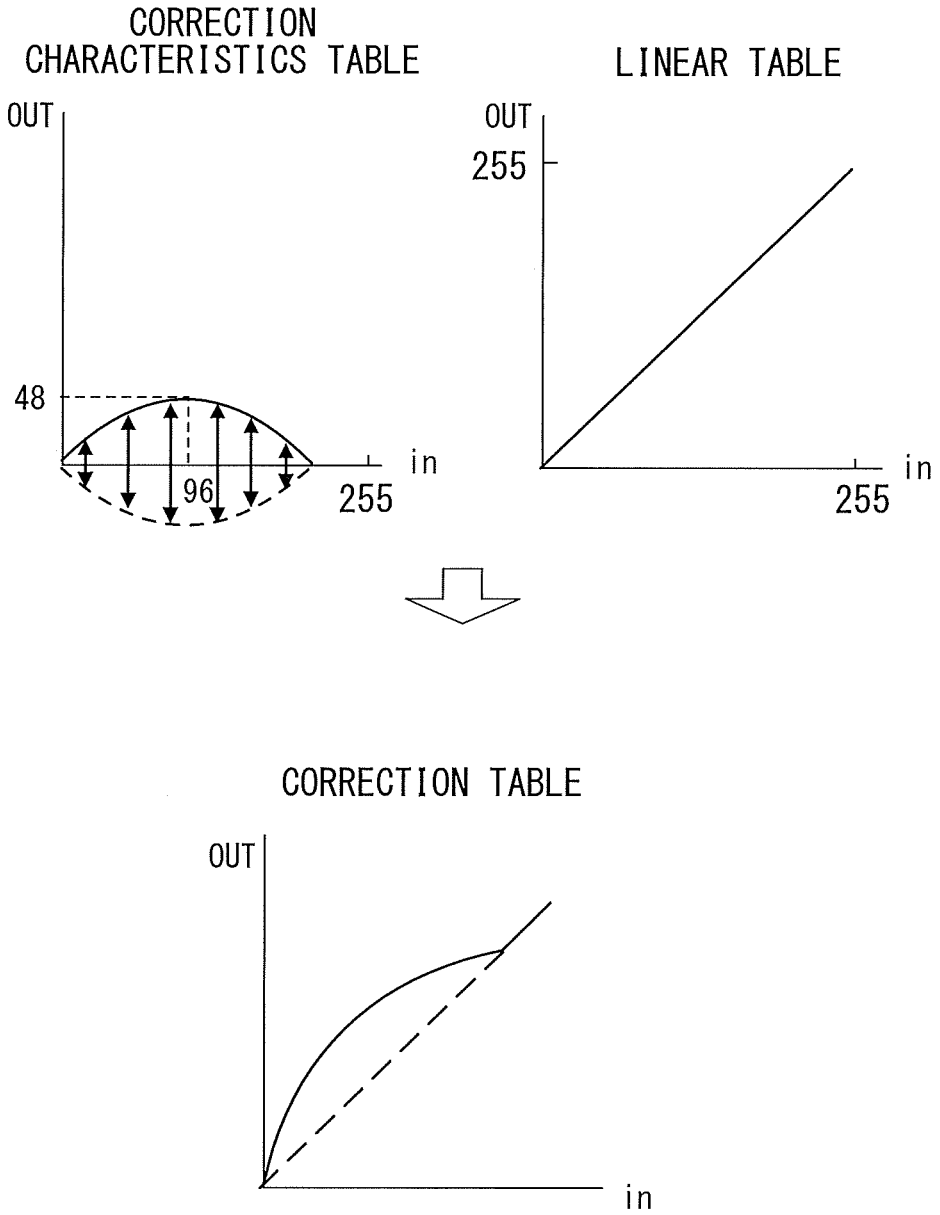
FIG. 16 is a diagram for illustrating a γ correction table.

FIG. 16 is a diagram for illustrating the γ correction table. A correction characteristics table has a correction value, which is determined for the image signal in consideration of basic characteristics of the image forming apparatus, set therein. Such correction characteristics table is set based on the specifications of the image forming apparatus. In the correction characteristics table in this embodiment, the input image signal of level "96" is a peak value of the amount of change in density value, the correction value is set to level "48". From this correction characteristics table, a correction value (vertical axis) for the image signal (horizontal axis) is determined. The correction value is a value "0 to 48" that is equal to or less than the peak of the amount of change. Moreover, the correction value is used to calculate an actual correction amount of the image signal (input signal) with the following expression:

(Correction amount)=(correction value)*(−(amount of change in density value)/(peak value of amount of change)).

The CPU 28 uses the expression to calculate a correction amount for each level (0 to 255) of the image signal. In a linear table, the input image signal and the output signal have equal values. The CPU 28 adds a correction amount of each level of the image signal to the linear table to generate a correction table.

For example, when the input image signal is "48" and the amount of change in density value is "10", a value obtained when the vertical axis is "48" (in this example, "40") is the correction value from the correction characteristics table. Therefore, the correction amount is (40*(−10/48))=−8.3. According to the correction table, a value obtained when the input image signal is "48" is (40−8.3)=39.7, which is about 40. The CPU 28 combines the thus-generated correction table and the LUT to generate the γ correction table.

FIG. 17 is a diagram for illustrating generation of the γ correction table. The CPU 28 uses the correction table to reference the LUT generated by the first control system, and replaces the LUT by the thus-generated γ correction table for use as an image forming condition at the time of actual image forming processing. The LUT generated by the first control system is stored in another region of the memory 25, and is referenced in the correction table in the processing repeatedly executed by the second control system. Through such processing, the image forming processing may be performed while maintaining initial image reproduction characteristics stably for a long time.

The image forming apparatus is often used by turning off the main power at night, and turning on the main power in the morning. Therefore, the processing using the second control system is executed once a day. In contrast, it is not probable that the processing using the first control system is performed frequently because the processing accompanies a human operation. In this embodiment, for example, a serviceman executes the processing using the first control system during an installation operation of the image forming apparatus, and unless a problem arises in the gradient characteristics, the gradient characteristics are maintained by the processing using the second control system. When the image forming apparatus is used for a long time, and when the gradient characteristics are gradually changed, the printer unit B is calibrated by the processing using the first control system. A change in gradient characteristics in a short term is addressed by the processing using the second control system. The gradient characteristics are maintained as described above by sharing the role between the first control system and the second control system, and hence image quality may be maintained until the end of life of the image forming apparatus.

In the processing using the first control system, automatic gradient correction is performed, and at the same time, the density conversion table 42*a* for converting the detection values from the photosensor 40 into the density values of the image formed on the recording material 6 is generated. In the processing to be repeatedly executed by the second control system, the LUT, which has been generated through the automatic gradient correction, may be corrected depending on the patch density values of the patch images on the photosensitive drum 4 to maintain the image density characteristics obtained by the automatic gradient correction for along term. Moreover, with the processing using the second control system, time required for the processing using the first control system is reduced. According to an experiment by the inventor(s) of this application, the time required for the processing using the first control system is reduced by 25% from the related art.

In this embodiment, the density conversion table 42*a* is generated, but may be stored in advance in the image forming apparatus. The correction characteristics table of FIG. 16 has set therein the correction value applicable to both an increase and decrease in amount of change of the density value, but for further optimization, may have set therein a correction value adapted to each of the increase side and the decrease side. Further, a plurality of correction characteristics tables may be prepared, and an optimal correction characteristics table may be used depending on the amount of change. In this embodiment, an image is formed on the photosensitive drum 4 with the laser beam, but without limiting to the laser beam, an exposure unit, for example, a light emitting diode (LED) may be used instead of the laser light source 110, for example.

Developer Density Control

In the image forming apparatus using a two-component developer containing toner and a carrier as main components, the toner is consumed every time the image forming processing is performed, and a developer density (mixture ratio between the toner and the carrier) inside the developing units 3 is changed. In order to keep the developer density constant, the image forming apparatus performs developer density control for accurately detecting the developer density and appropriately supplying the toner.

In this embodiment, the photosensor 40 is configured to detect the developer density. The image forming apparatus is configured to form a patch latent image on the photosensitive drum 4 having a charged surface at a predetermined contrast potential. The developing units 3 are configured to develop the patch latent image with the two-component developer. As a result, a developed patch, which is a toner image, is formed on the photosensitive drum 4. The photosensor 40 is configured to detect the density of the developed patch by irradiating the developed patch with light, and receiving the light reflected by the developed patch. The CPU 28 of the printer controller 109 detects the developer density based on a detection value of the photosensor 40. The CPU 28 uses a developing density conversion table for converting the detection value from the photosensor 40 into the developer density to detect the developer density. The developing density conversion table is a table that is different from the density conversion table 42*a*.

An initial density of the developer density is set when the image forming apparatus is installed and when the developer is replaced. In other words, the image forming apparatus forms the developed patch, which is a toner image, on the photosensitive drum 4 when the image forming apparatus is installed and the developer is replaced, and sets, as the initial density, the detection value of the developed patch from the photosensor 40.

The CPU 28 performs the developer density control with reference to the initial density. For example, the CPU 28 adjusts an amount of toner in the developing units 3 so as to adjust the developer density, which has been detected using the photosensor 40, to the initial density. Therefore, during the developer density control, there is a need to form the developed patch on the photosensitive drum 4 under the same conditions as those when the initial density is set, and to detect the developed patch by the photosensor 40. In the developer density control, a relationship between the developed patch on the photosensitive drum 4 and the developer density is detected, and hence a change in characteristics of the transferring and fixing performed in the second control system is irrelevant. Therefore, there is no need to reflect the density conversion table 42*a*, which is generated by the first control system, to the developing density conversion table in the developer density control.

FIG. 18 is a table for showing items that affect the detection values from the photosensor 40 and the image densities on the recording material 6.

In the image forming processing, the change in characteristics of the transferring and fixing, which are performed after the image is formed on the photosensitive drum 4, affects the relationship between the detection values of the image densities on the photosensitive drum 4 and the image densities on the recording material 6. Therefore, in the second control system, the items that affect the detection values from the photosensor 40 and the image densities on the recording material 6 include an individual difference of the photosensor 40, and the image densities on the photosensitive drum 4 and the image densities on the recording material 6. In the processing using the second control system, the image densities on the photosensitive drum 4 and the developer density inside the developing units 3 do not affect the detection values from the photosensor 40 and the image densities on the recording material 6. In order to suppress such effects, the density conversion table 42*a* for determining the relationship between the detection values from the photosensor 40 and the image densities on the recording material 6 is generated to address the individual difference of the photosensor 40 and the change in characteristics of the transferring and fixing.

In the developer density control, the developer density inside the developing units 3 is detected, and hence the items that affect the detection values from the photosensor 40 and the image densities on the recording material 6 include the individual difference of the photosensor 40, and the image densities on the photosensitive drum 4 and the developer density inside the developing units 3. In the developer density control, the image densities on the photosensitive drum 4 and the image densities on the recording material 6 do not affect the detection values from the photosensor 40 and the image densities on the recording material 6. Therefore, in the developer density control, the density conversion table 42*a* is unnecessary. In the developer density control, in order to suppress the effects on the detection values from the photosensor 40 and the image densities on the recording material 6, the initial density of the developer density is detected and stored.

The detection of the initial density in the developer density control is a specialized operation, and generates downtime. However, the frequency of replacing the developer is low, and other operation time is also required accompanying the replacement, with the result that the effects which the detection of the initial density has on the entire processing do not cause a problem.

A plurality of developing density conversion tables for converting the detection values from the photosensor 40 into the developer densities may be provided depending on the image forming apparatus and a control configuration thereof. In this case, whether or not to generate and correct the developing density conversion table may be set for each of the developing density conversion tables to improve the accuracy of the conversion.

As described above, the image forming apparatus according to this embodiment may suppress the downtime of the calibration for compensating, based on the measurement result of the measurement image before being fixed onto the recording material, for the measurement result of the measurement image fixed onto the recording material with high accuracy.

Figure 19:
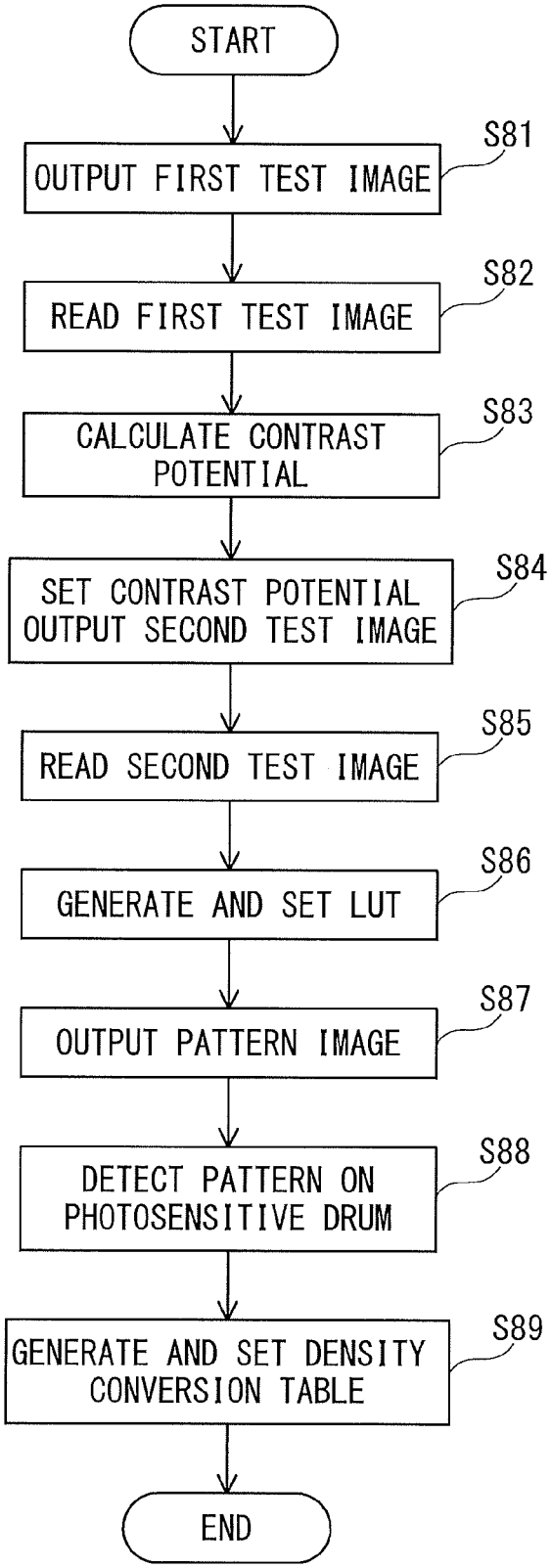
FIG. 19 is a flow chart for illustrating processing for calibrating the printer unit (modification example).

Next, a modification example of the calibration processing in the present invention is described. FIG. 19 is a flow chart for illustrating calibration processing of the printer unit B using the reader unit A. Processing in Steps S81, S82, and S83 is similar to the processing in Steps S51, S52, and S53 of FIG. 6. Therefore, a description of Steps S81, S82, and S83 is omitted.

Processing of Step S84: The CPU 214 controls the printer unit B based on the contrast potential calculated in the processing of Step S83, and instructs the printer unit B to form the second test image. The printer unit B forms the second test image, which is the measurement image, in response to the instruction. The second test image is the same as that of FIG. 8, and hence a description thereof is omitted.

Processing of Step S85: The user places the recording material 6 having the second test image formed thereon on the platen 102 of the reader unit A to have the second test image read by the reader unit A. When the recording material 6 is placed on the platen 102, the CPU 214 of the reader unit A displays, on the display unit 218, a start button for reading an image. When the user presses the start button, the CPU 214 performs control to read the second test image from the recording material 6 placed on the platen 102. The reader image processor 108 converts the color component signals (RGB signal values) acquired from the light receiving unit 105 into density signals indicating optical densities as in the processing of Step S52.

Processing of Step S86: The CPU 214 generates the LUT. A method of generating the LUT is a known art and a description thereof is thus omitted. The CPU 214 updates the LUT stored in the memory 25 with the generated LUT described above.

Figure 20:
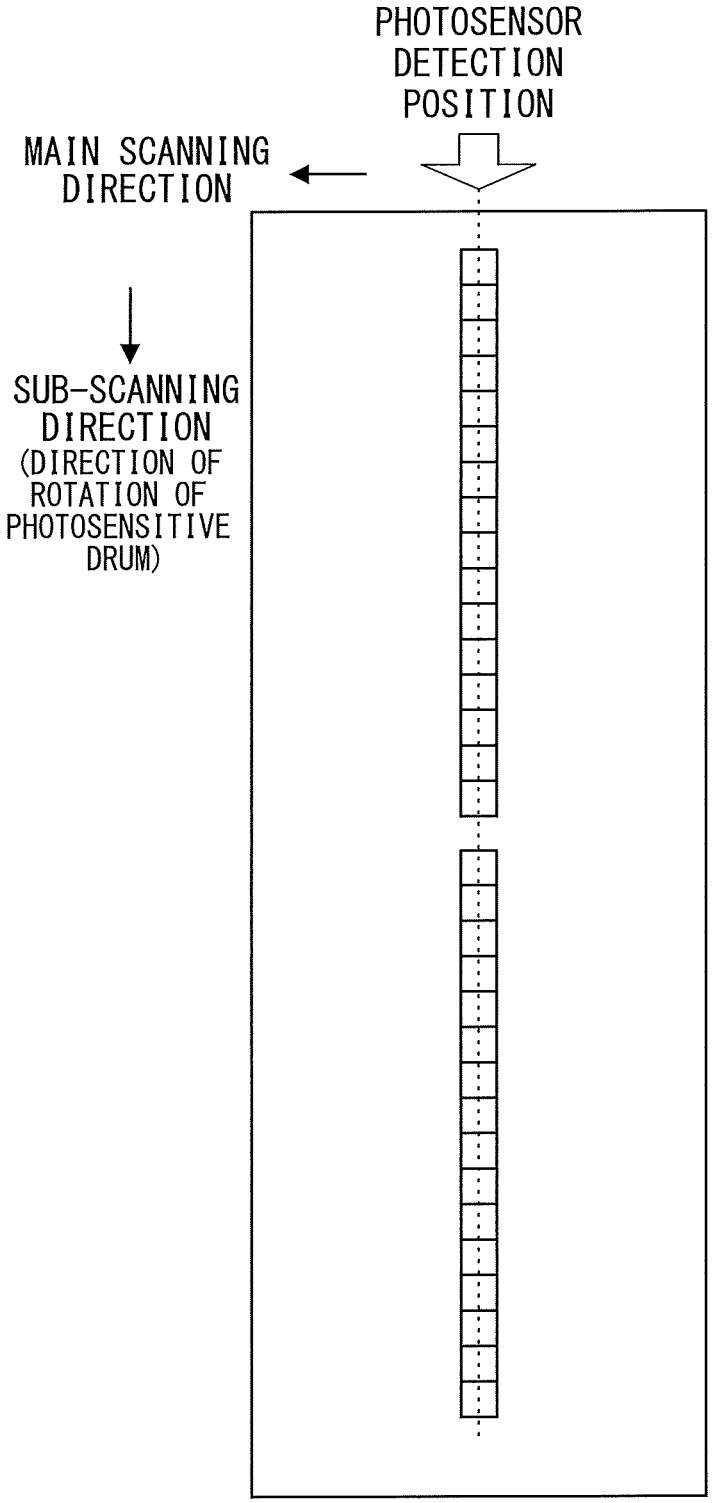
FIG. 20 is a schematic diagram of a pattern image in a modification example.

Processing of Step S87: After the second test image is formed on the recording material 6, the CPU 214 controls the printer unit B to form a pattern image on the photosensitive drum 4. FIG. 20 is a schematic diagram of the pattern image formed on the photosensitive drum 4 in the processing of Step S87. Image signal values for forming the pattern image of FIG. 20 correspond to four signal values of the image signal values for forming the second test image, which is formed on the recording material 6 in the processing of Step S84. The number of gradients of the pattern image illustrated in FIG. 20 is smaller than the number of gradients of the second test image. The pattern image illustrated in FIG. 20 is formed in four gradients for each color, for example. The pattern image illustrated in FIG. 20 is formed using different screens of 200 dpi and 400 dpi, for example.

Processing of Step S88: The CPU 214 has the pattern image on the photosensitive drum 4 measured by the photosensor 40.

Processing of Step S89: The CPU 214 generates the density conversion table based on the detection values of the image densities on the photosensitive drum 4, which have been measured by the photosensor 40 in the processing of Step S88, and the densities of the second test image corresponding to the pattern image. Then, the CPU 214 sets the generated density conversion table. The CPU 214 stores the generated density conversion table in the memory 25.

As described above, the image forming apparatus in the modification example forms the second test image, and then forms the pattern image on the photosensitive drum 4 in the calibration. Then, the image forming apparatus in the modification example updates, based on the detection result of the pattern image and the result of reading the second test image, the density conversion table for use in the second control system. Therefore, the image forming apparatus in the modification example may generate the density conversion table for converting the detection result of the pattern image in the second control system with high accuracy, based on the pattern image on the photosensitive drum 4 and the second test image on the recording material. Moreover, the image forming apparatus in the modification example updates the density conversion table while the processing using the first control system is executed, and hence the downtime for generating the density conversion table may be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-031380, filed Feb. 22, 2016 which is hereby incorporated by reference herein in its entirety.

What is claimed is:

1. An image forming apparatus comprising:

a correction unit configure to correct image data based on a correction condition;

an image bearing member;

an image forming unit configured to form an image on the image bearing member, based on the corrected image data;

a transfer unit configured to transfer the image onto a recording material;

a measurement unit configured to measure a measurement image formed on the image bearing member;

a converting unit configured to convert, based on a conversion condition, a measurement result of the measurement image measured by the measurement unit;

a first generating unit configured to:

control the image forming unit to form the measurement image, control the measurement unit to measure the measurement image, control the converting unit to convert the measurement result of the measurement image, and generate the correction condition based on the measurement result converted by the converting unit; and a second generating unit configured to:

control the image forming unit to form a test image, control the transfer unit to transfer the test image onto the recording material, obtain reading data related to the test image transferred onto the recording material, wherein the reading data is output from a reading device, and generate the correction condition based on the reading data, wherein the second generating unit controls the measurement unit to measure the test image formed on the image bearing member before the test image is transferred onto the recording material, and generates the conversion condition based on the reading data and the measurement result of the test image by the measurement unit.

2. The image forming apparatus according to claim 1, wherein the converting unit converts density data from the measurement result of the measurement image, based on the conversion condition, and wherein the first generating unit determines a correction amount based on a result of comparison between the density data converted by the converting unit and a reference density data, and generates the correction condition based on the correction amount.

3. The image forming apparatus according to claim 2, wherein the first generating unit controls the correction unit to correct measurement image data based on the correction condition, controls the image forming unit to form reference measurement image based on the corrected measurement image data, controls the measurement unit to measure the reference measurement image, updates the reference measurement result based on a measurement result of the reference measurement image.

4. The image forming apparatus according to claim 1, wherein the image forming unit forms images each having a different color, and wherein the first generation unit generates correction condition for each color.

5. The image forming apparatus according to claim 1, wherein the correction condition corresponds to a tone correction table.

6. An image forming method executed in an image forming apparatus, the image forming apparatus including:

a correction unit configured to correct image data based on a correction condition; an image bearing member;

an image forming unit configured to form an image on the image bearing member, based on the corrected image data;

a transfer unit configured to transfer the image onto a recording material;

a measurement unit configured to measure the measurement image formed on the image bearing member; and a converting unit configured to convert, based on conversion condition, a measurement result of the measurement image measured by the measurement unit, the image forming method comprising:

controlling the image forming unit to form the measurement image, controlling the measurement unit to measure the measurement image, controlling the converting unit to convert the measurement result of the measurement image, generating the correction condition based on the measurement result converted by the converting unit;

controlling the image forming unit to form a test image, controlling the transfer unit to transfer the test image onto the recording material, obtaining reading data related to the test image transferred onto the recording material, wherein the reading data is output from a reading device, and generating the correction condition based on the reading data, wherein the measurement unit is controlled to measure the test image formed on the image bearing member before the test image is transferred onto the recording material, and the conversion condition is generated based on the reading data and the measurement result of the test image by the measurement unit.

* * * * *